US005702873A

United States Patent [19]

Twist

[11] Patent Number: 5,702,873

[45] Date of Patent: Dec. 30, 1997

[54] REDOX AMPLIFICATION SOLUTIONS CONTAINING METAL ION SEQUESTERING AGENTS

[75] Inventor: Peter Jeffery Twist, Gt Missenden, United Kingdom

[73] Assignee: Eastman Kodak Company, Rochester, N.Y.

[21] Appl. No.: 630,196

[22] Filed: Apr. 10, 1996

Related U.S. Application Data

[63] Continuation of Ser. No. 244,350, filed as PCT/EP92/02763, Nov. 30, 1992, abandoned.

[30] Foreign Application Priority Data

Dec. 3, 1991 [GB] United Kingdom ..... 9125689

[51] Int. Cl.[6] ..... G03C 7/00; G03C 7/26; G03C 9/18; G03C 9/26

[52] U.S. Cl. ..... 430/373; 430/936; 430/943; 430/380; 430/414; 430/469; 430/490; 430/491; 430/492

[58] Field of Search ..... 430/373, 380, 430/419, 448, 469, 487, 490, 491, 492, 493, 936

[56] References Cited

U.S. PATENT DOCUMENTS

| | | | |
|---|---|---|---|
| 3,746,544 | 7/1973 | Heilmann | 96/66.4 |
| 3,994,730 | 11/1976 | Frank et al. | 96/66.4 |
| 4,172,726 | 10/1979 | Nakamuro et al. | 430/373 |
| 4,264,716 | 4/1981 | Vincent et al. | 430/491 |
| 4,529,687 | 7/1985 | Hirai et al. | 430/373 |
| 4,791,048 | 12/1988 | Hirai et al. | 430/491 |
| 4,853,318 | 8/1989 | Fujita et al. | 430/380 |
| 4,880,725 | 11/1989 | Hirai et al. | 430/373 |
| 4,892,804 | 1/1990 | Vincent et al. | 430/380 |
| 4,975,397 | 12/1990 | Buengionne et al. | 430/491 |

FOREIGN PATENT DOCUMENTS

| | | | |
|---|---|---|---|
| 0286874 | 10/1988 | European Pat. Off. | 430/491 |
| 26 46 807 | 4/1978 | Germany . | |
| 63-144352 | 6/1988 | Japan | 430/491 |
| 795914 | 6/1958 | United Kingdom | 430/491 |
| 1 268 126 | 3/1972 | United Kingdom . | |
| 1 399 481 | 7/1975 | United Kingdom . | |
| 1 403 418 | 8/1975 | United Kingdom . | |
| 1 560 572 | 2/1980 | United Kingdom . | |
| 2 059 616 | 4/1981 | United Kingdom . | |
| WO 87/04534 | 7/1987 | WIPO . | |
| WO 90/13061 | 11/1990 | WIPO . | |
| WO 90/14615 | 11/1990 | WIPO . | |
| WO 93/01524 | 1/1993 | WIPO . | |

OTHER PUBLICATIONS

Research Disclosure 13524, Jul. 1975, p. 18, Wyatt et al.

Research Disclosure 17048, Jun. 1978, pp. 58–59, Powell et al.

Research Disclosure, No. 116, Dec. 1973, pp. 109–114.

*Primary Examiner*—Glenn A. Caldarola

*Assistant Examiner*—J. Pasterczyk

*Attorney, Agent, or Firm*—Lee Fleckenstein

[57] ABSTRACT

A redox-amplification solution comprising hydrogen peroxide, or a substance capable of releasing hydrogen peroxide, or reducing agent, such as a color developing agent, and in combination three or more sequestering agents for complexing with a transition metal ion to inhibit catalysis of impurities emanating from a photographic film coating and enhance the stability of the solution; a method of photographic color processing including a step using the redox-amplification solution and its use therefor.

20 Claims, 6 Drawing Sheets

Figure 1:
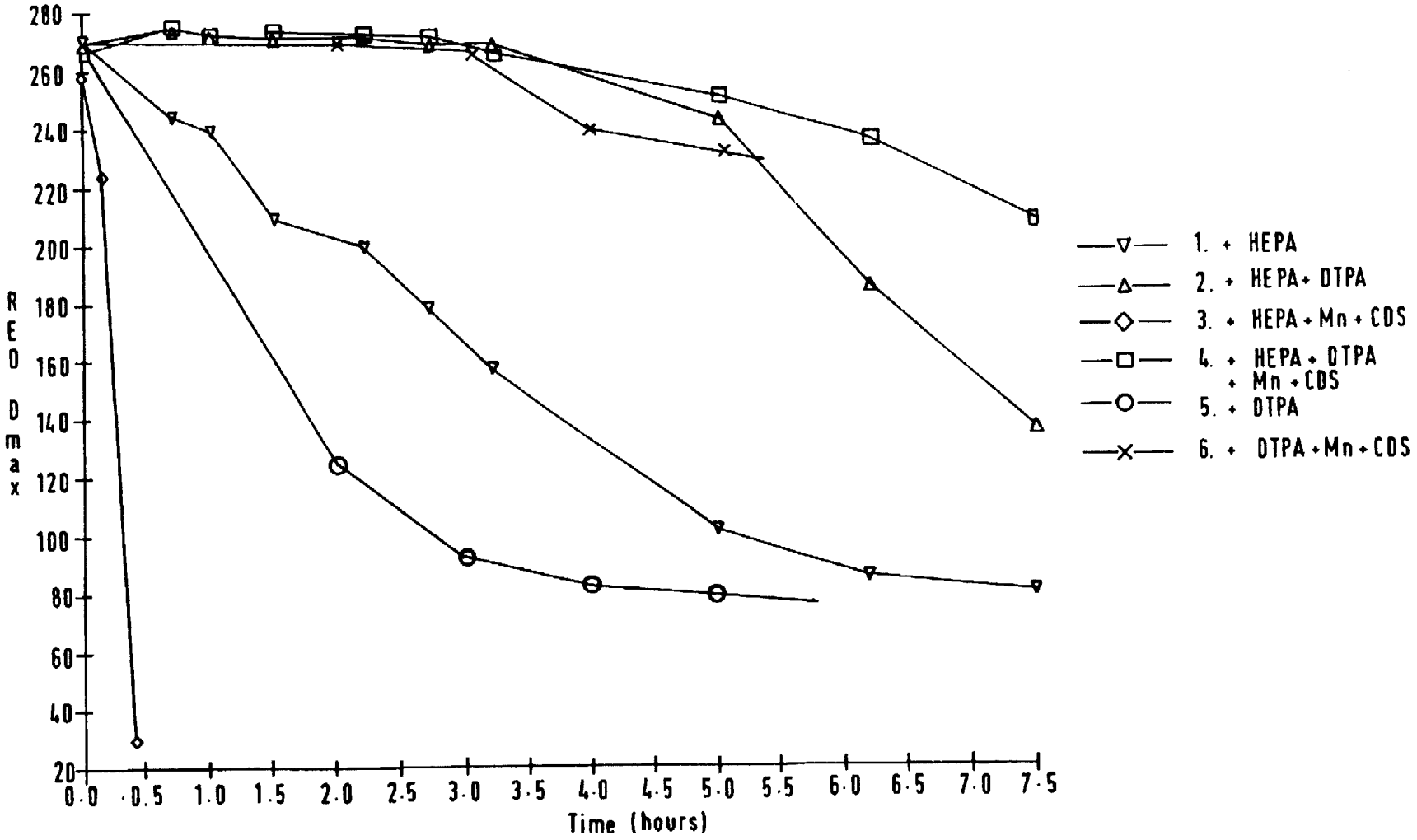

RED O max
300
260
220
180
140
100
60
0
1
2
3
4
5
6
7
8
Time(hours)
1. HEPA
2. HEPA+2ml/l DTPA
3. HEPA+4ml/l DTPA
4. HEPA+6·5ml/l DTPA
5. HEPA+6·5ml/l DTPA
+ Mn+COS

REDOX AMPLIFICATION SOLUTIONS CONTAINING METAL ION SEQUESTERING AGENTS

This application is a continuation of U.S. patent application Ser. No. 08/244,350, filed as PCT/EP92/02763 Nov. 30, 1992, now abandoned.

This invention relates to photographic developer solutions for use in photographic colour processing and in particular to redox developer solutions.

Redox (or RX) amplification processes have been described, for example, in British specification Nos. 1,268,126, 1,399,481, 1,403,418 and 1,560,572. In such processes colour materials are developed to produce a silver image (which may contain only small amounts of silver) which then catalyses redox amplification to form a dye image. The redox amplifying solution contains a reducing agent, for example a colour developing agent, and an oxidising agent which is more powerful than silver halide and which will oxidise the colour developing agent in the presence of the silver image which acts as the catalyst. The oxidised colour developer reacts with a colour coupler (usually contained in the photographic material) to form image dye. The amount of dye formed depends on the time of treatment or the availability of colour coupler rather than the amount of silver in the image as is the case in conventional colour development processes. A particular application of this technology is in the processing of silver chloride colour paper, especially such paper with low silver levels.

Since the amplifying solution contains both an oxidising agent and a reducing agent it is, however, inherently unstable and will decompose on keeping. This instability is catalysed during the processing by the seasoning of species present in the gelatin layer in the photographic material, such as complex transition metal ions such as manganese (Mn), and/or catechol disulphonate 'CDS', TIRON™.

In conventional RA-4 type developers this catalytic effect can be substantially reduced or nullified by the addition of one or more sequestering agents which can form a fairly stable soluble complex with the calcium ions or transition metal ions so that the free metal ions, especially ferric ions, are then present in only minute amounts. Such sequestering agents may include, for example, a polyacetic acid such as diethylaminetriamine pentaacetic acid 'DTPA' or an alkylidene -1,1-diphosphonic acid, such as 1-hydroxyethylidene-1,1-diphosphonic acid 'HEPA'.

It is disclosed in co-pending U.K. application No. 9125687.5, filed on even date herewith, that a single sequestering agent but more particularly a combination of two or more sequestering agents can have a surprising stabilising effect in inhibiting catalytic decomposition of a photographic bleach solution.

It has now been found that in the redox developer field, whilst the addition of a single sequestering agent, such as 'DTPA' or a salt thereof, to a redox amplification solution has very little stabilising effect, the combination of two or more classes of sequestering agents may produce a synergistic effect, showing substantial inhibition of the catalytic effect caused by seasoning of the impurities inherent in or added to the photographic film coating. Moreover, the effect of this inhibition is greater than just the removal of the catalytic effect of, for example, Mn and/or 'CDS' and results unexpectedly in a significant improvement in the stability of RX developers compared to a control without species such as Mn and/or 'CDS'. Indeed the stability may be improved to an extent that the amount of Time Dependent Replenisher (TDR) normally needed to maintain such a solution in a satisfactory operating condition is significantly reduced, and may even be reduced to zero.

According to the present invention therefore there is provided a redox-amplification solution comprising hydrogen peroxide or a substance capable of releasing hydrogen peroxide, a reducing agent, such as a colour developing agent, and in combination two or more sequestering agents for complexing with a transition metal ion to inhibit catalysis of impurities emanating from a photographic film coating and enhance the stability of the solution.

One class of sequestering agent that is present according to the invention is a polyalkylcarboxylic, phosphonic or sulphonic acid containing at least one amine group which has condensed with one or more alkyl hydrogens of the alkylcarboxylic, phosphonic, or sulphonic-acid, which may be represented by the formula (I)

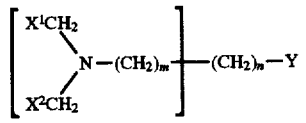

(I)

A wherein $X^1$ and $X^2$ may be the same or different and each is a hydrogen atom, a straight or branched chain alkyl group having 1 to 6 carbon atoms, a hydroxyl, carboxyl, sulphonyl or phosphonyl group or the group Z, wherein Z=

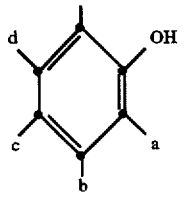

wherein a, b, c and d are the same or different and each is a hydrogen atom, a straight or branched chain alkyl group having 1 to 6 carbon atoms, a hydroxyl, carboxyl, sulphonyl or phosphonyl group or either $X^1$ and/or $X^2$ may be repeat units of A or B, Y is as defined for a, b, c and d or is the group Z or the group B,

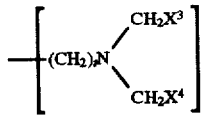

B wherein $X^3$ and $X^4$ are the same or different and are as defined for $X^1$ and $X^2$ wherein the sum of m, n and r is an integer from 1 to 10 and wherein one or both of the hydrogen atoms in each of the $(CH_2)_m$,$(CH_2)_n$ or $(CH_2)_r$ groups may be replaced by a straight or branched chain alkyl group having 1 to 6 carbon atoms, with the proviso that at least one of $X^1$, $X^2$, $X^3$ and $X^4$ is or contains a carboxylic, sulphonyl or phosphonyl group, or a salt thereof.

Examples of compounds of formula (I) that are particularly suitable are ethylenediaminetetraacetic acid 'EDTA', propylenediaminetetraacetic acid 'PDTA', nitrilotriacetic acid 'NTA' but most preferably diethylenetriaminepentaacetic acid 'DTPA', these compounds generally being used in the form of their corresponding tetra- or penta-sodium salts.

For the practice of the invention, in a preferred mode, a compound of formula (I), or a salt thereof, is combined with either an alkylidene-1,1-diphosphonic acid, such as a compound of formula (II), as defined hereinbelow and/or a polyhydroxyl phenyl, such as a compound of formula (III), as defined hereinbelow.

A compound of formula (II) is defined as

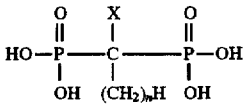

(II)

wherein X=a hydrogen atom or a halogen or hydroxyl group, n=0–12 and especially 1-hydroxy-ethylidene-1,1-diphosphonicacid (X=OH; n=1)

The compound of formula (III) is defined as

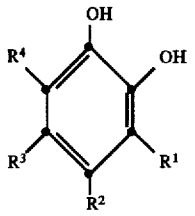

wherein $R^1$, $R^2$, R3 and $R^4$ are the same or different and each is a hydrogen atom, a straight or branched chain alkyl group having 1 to 6 carbon atoms, a hydroxyl, sulphonyl or carboxyl group and is especially dihydroxyphenyl sulphonate ('catechol' disulphonate 'CDS') or TIRON™.

According to the present invention therefore in a preferred aspect there is provided a redox-amplification solution comprising hydrogen peroxide or a substance capable of releasing hydrogen peroxide, a reducing agent, such as a colour developing agent, and a compound of formula (I), as hereinbefore defined, or a salt thereof, in combination with either a compound of formula (II), as hereinbefore defined and/or a compound of formula (III), as hereinbefore defined, for complexing with a transition metal ion to inhibit catalysis of impurities emanating from a photographic film coating and enhance the stability of the solution.

In a more preferred aspect of the invention the redox-amplification solution comprises a compound of formula (I), or a salt thereof, in combination with both a compound of formula (II) and a compound of formula (III). Most preferably the redox-amplification solution comprises diethylenetriaminepentaacetic acid, 'DTPA' or a salt thereof and 1-hydroxy-ethylidene-1,1-diphosphonic acid, 'HEPA'.

These sequestering agents may be combined with the ratio of amy two components being in the range 1 to 20:1 by volume, wherein either component may be present in the greater amount. Each sequestering agent is added in an amount of from 0.05 ml to 100 ml/liter of redox solution, preferably 1 ml to 10 ml, most preferably 2 ml to 6.5 ml.

Compounds capable of releasing hydrogen peroxide include metal peroxides; compounds which include hydrogen peroxide in their crystal structure such as sodium percarbonate; other peroxy compounds such as sodium perborate and persulphate; or soluble organic peroxides, such as butyl peroxide or benzyl peroxide.

The hydrogen peroxide or a compound such as mentioned above is added in a sufficient quantity to oxidise the colour developing agent in a suitable length of time. Conveniently commercially available 30% hydrogen peroxide is used in an amount of from 0.5 to 100 ml/liter amplification bath, preferably about 5 ml/liter, but equivalent amounts of, for example, 8% or 3% hydrogen peroxide may also be used.

The reducing agent, which is generally a colour developing agent, may be any primary aromatic amine, such as a p-aminophenol or p-phenylenediamine. Colour developing agents which can be used include 4-amino-N,N-diethylaniline hydrochloride, 4-amino-3-methyl-N,N-diethylaniline hydrochloride, 4-amino-3-methyl-N-ethyl-N-β-hydroxyethylaniline sulphate and preferably N-ethyl-N-β-methanesulphon-amidoethyl-3-methyl-4-aminoaniline (CD3).

The reducing agent is added in an amount of from about 1 to 20 g/liter, preferably 2 to 5 g/liter.

The redox amplification solution preferably has one or more acids, alkalis or buffers , such as an alkali metal carbonate, carbonate/hydrogen carbonate buffer or phosphate buffer to maintain the pH at the required level, which is usually at about pH 10.

The solution must be well buffered to provide a large reservoir of hydroxyl ions as a hydrogen ion is produced for each atom of metallic silver formed. As the pH rises the colour developing agent becomes a more powerful reducing agent with respect to the silver and therefore there is a higher rate of photographic development. However a high pH makes the developer more susceptible to aerial oxidation and hence more developing agent or protection from oxygen is required. Conveniently an anti-oxidant such as diethylhydroxylamine may be used.

The redox amplification solutions of the present invention may be used with any type of photographic silver halide colour material. Such materials and their possible constituents are described, for example, in Research Disclosure Item 308119, December 1989, published by Kenneth Mason Publications, Emsworth, Hants, United Kingdom. However materials based on predominantly silver chloride emulsions are preferred.

The present invention also provides a method of photographic colour processing including a redox amplification step, which comprises the addition of hydrogen peroxide, or a compound capable of releasing hydrogen peroxide, a reducing agent, such as a colour developing agent, a compound formula (I), as hereinbefore defined, with either a compound of formula (II), as hereinbefore defined and/or a compound of formula (III) as hereinbefore defined, for complexing with a transition metal ion to inhibit catalysis of impurities emanating from a photographic film coating and enhance the stability of the solution.

The redox amplification stage may be followed directly by a bleach step or an intermediate stop bath may be employed.

The photographic material to be processed preferably contains low levels of silver to reduce light scattering and is preferably based on emulsions which comprise at least 80%, preferably at lear 90%, silver chloride and especially substantially pure silver chloride.

The invention will now be described with reference to the following examples which in no way limit the scope of the invention.

EXAMPLE 1

A developer-amplifier (DEVAMP) of the following composition was prepared:

| Component | Concentration |
|---|---|
| Potassium carbonate | 10.0 g/l |
| Potassium bromide | 1.0 mg/l |
| Potassium chloride | 0.35 g/l |
| Diethylhydroxylamine (anti-oxidant) | 4.0 ml/l |
| CD3 (colour developing agent) | 3.5 g/l |
| $H_2O_2$ (30%) | 5.0 ml/l |

-continued

| Component | Concentration |
|---|---|
| pH | 10.3 |
| Temperature | 35° C. |

A solution of each of the following in tap water containing approximately 200 ppm of equivalent calcium carbonate was prepared and transferred to glass cylinders maintained at 35° C. in a water thermostat.

1 The solution as above+0.6 g/l of a 60% solution in water of 1-hydroxy-ethylidene-1,-1-diphosphonic acid 'HEPA' (0.36 g/l, $1.7\times10^{-3}$ mole/l of 'HEPA')

2 1+6.5 ml/l of a 40% solution in water of the penta-sodium salt of diethylenetriaminepentaacetic acid 'DTPA' (3.4 gl, $6.8\times10^{-3}$ mole/l of 'DPTA')

3 1+5 ppm manganese (as manganese sulphate) +0.5 g/l, $1.9\times10^{-3}$ mole/l catechol disulphonate 'CDS'

4 2+5 ppm Mn+0.5 g/l, $1.9\times10^{-3}$ mole/l 'CDS'

5 The solution as above+6.5 ml/l 40% solution in water of the penta-sodium salt of 'DTPA'

6 5+5 ppm Mn+0.5 g/l, $1.9\times10^{-3}$ mole/l 'CDS'

Small strips of exposed photographic paper were processed from time to time to monitor the activity of the DEVAMP solution.

The results of the stability test in terms of red Dmax reflection density for a neutral exposure are shown graphically in FIG. 1.

The stability of solution 1, with sequestrant 'HEPA' only declined steadily, losing 20% Dmax in 1.5 hours and similarly solution 5 with sequestrant 'DTPA' only fell to less than 50% Dmax in the first 2 hours. The Dmax of solution 3 fell even more sharply, losing its activity entirely in about 20 minutes.

However, no apparent stability loss occurred for over 3 hours with solutions 2, 4 and 6, with solution 4 surprisingly being the most stable and retaining 80% activity even after 7.5 hours, solution 2 having tailed off to 50% activity after this time and solution 6 retaining 85% after 5 hours.

Figure 2:
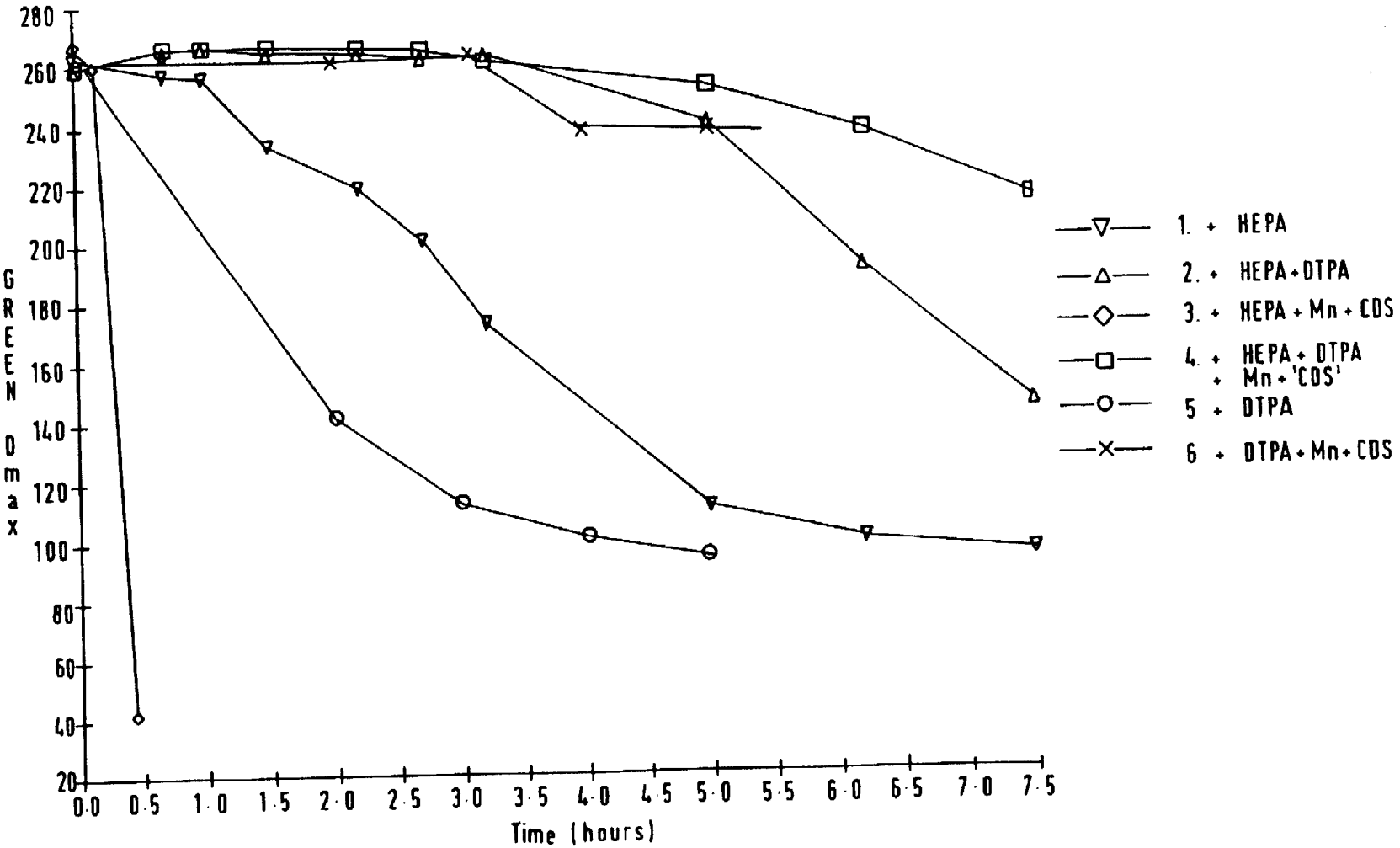
Figure 3:
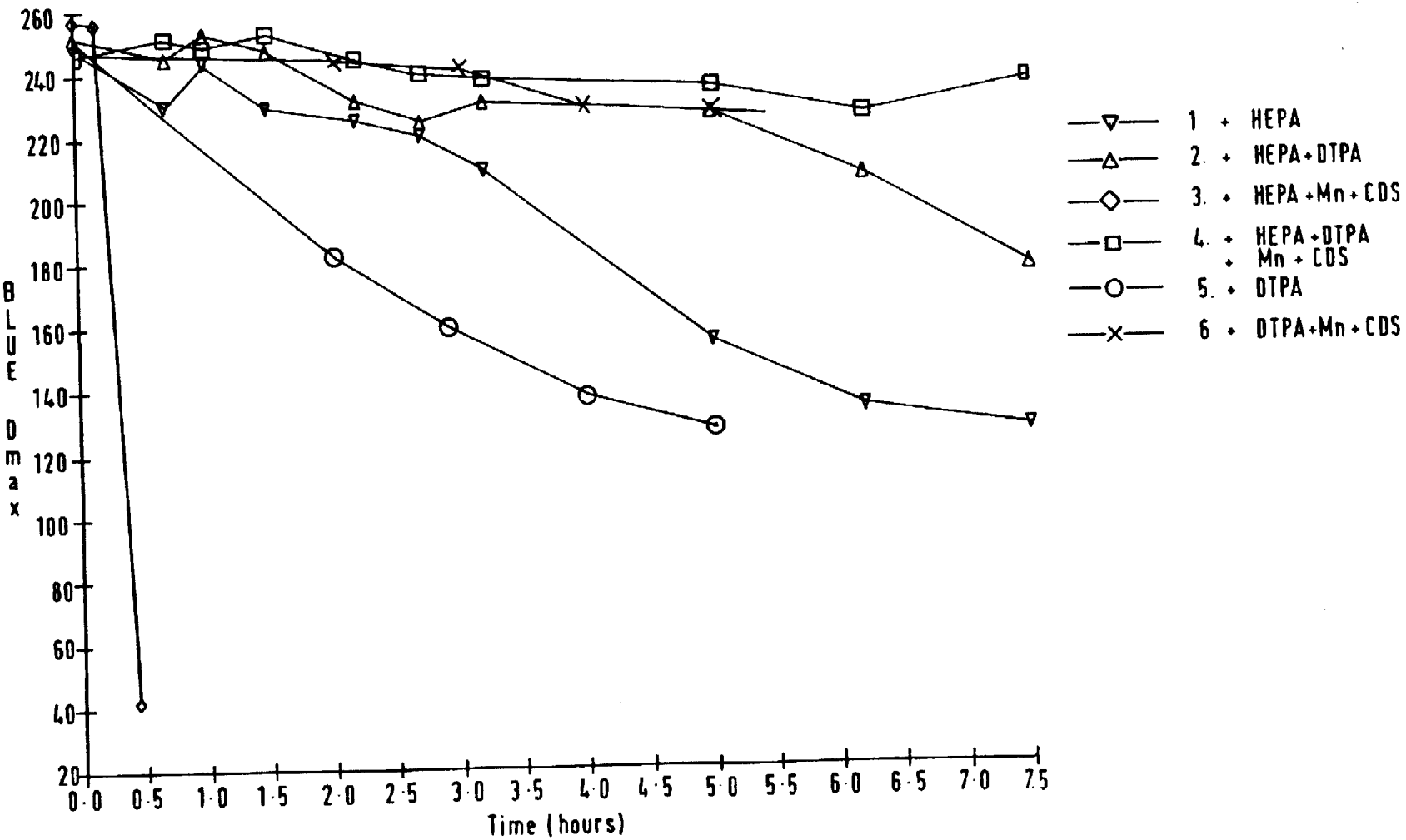

Similar results were found for green and blue Dmax and these are shown in FIGS. 2 and 3 respectively, results for green Dmax mirroring these for red Dmax and those for blue Dmax showing a similar trend except that there was an unexpected upsurge in activity after 6 hours with solution 4 close to maximum activity after 7.5 hours. These results clearly show that when 'DTPA' is present in combination with either 'HEPA' (solution 2) or 'CDS' (solution 6) a significant improvement in stability results, which is not found with a solution containing both 'HEPA' and 'CDS' with no 'DTPA' (solution 3). However, the most stable DEVAMP solution is one in which 'DTPA', 'HEPA' and 'CDS' are all present (solution 4).

EXAMPLE 2

A developer-amplifier of the composition shown in Example 1 was prepared and a solution of each of the following in tap water containing approximately 200 ppm of equivalent calcium carbonate prepared and transferred to glass cylinders maintained at 35° C. in a water thermostat.

1. Solution 1 as in Example 1, including 0.6 g/l of a 60% solution in water of 'HEPA' (0.36 g/l, $1.7\times10^{-3}$ mole/l of 'HEPA'

2. 1+2ml/l 'DTPA' (1.05 g/l, $2.1\times10^{-3}$ mole/l of 'DTPA')

3. 1+4ml/l 'DTPA' (2.1 g/l, $4.2\times10^{-3}$ mole/l of 'DPTA')

4. 1+6.5ml/l 'DTPA' (3.4 g/l, $6.8\times10^{-3}$ mole/l of 'DTPA')

5. 4+10 ppm manganese (as manganese sulphate)+0.6g/l, $2.2\times10^{-3}$ mole/l 'CDS'.

In the above solutions 2–4, the 'DTPA' is used in the form of a 40% solution of its penta-sodium salt.

As before, small strips of exposed photographic paper were processed from time to time over a total of 7.5 hours to monitor the stability effect of the 'DTPA', and Mn/'CDS'.

Figure 4:
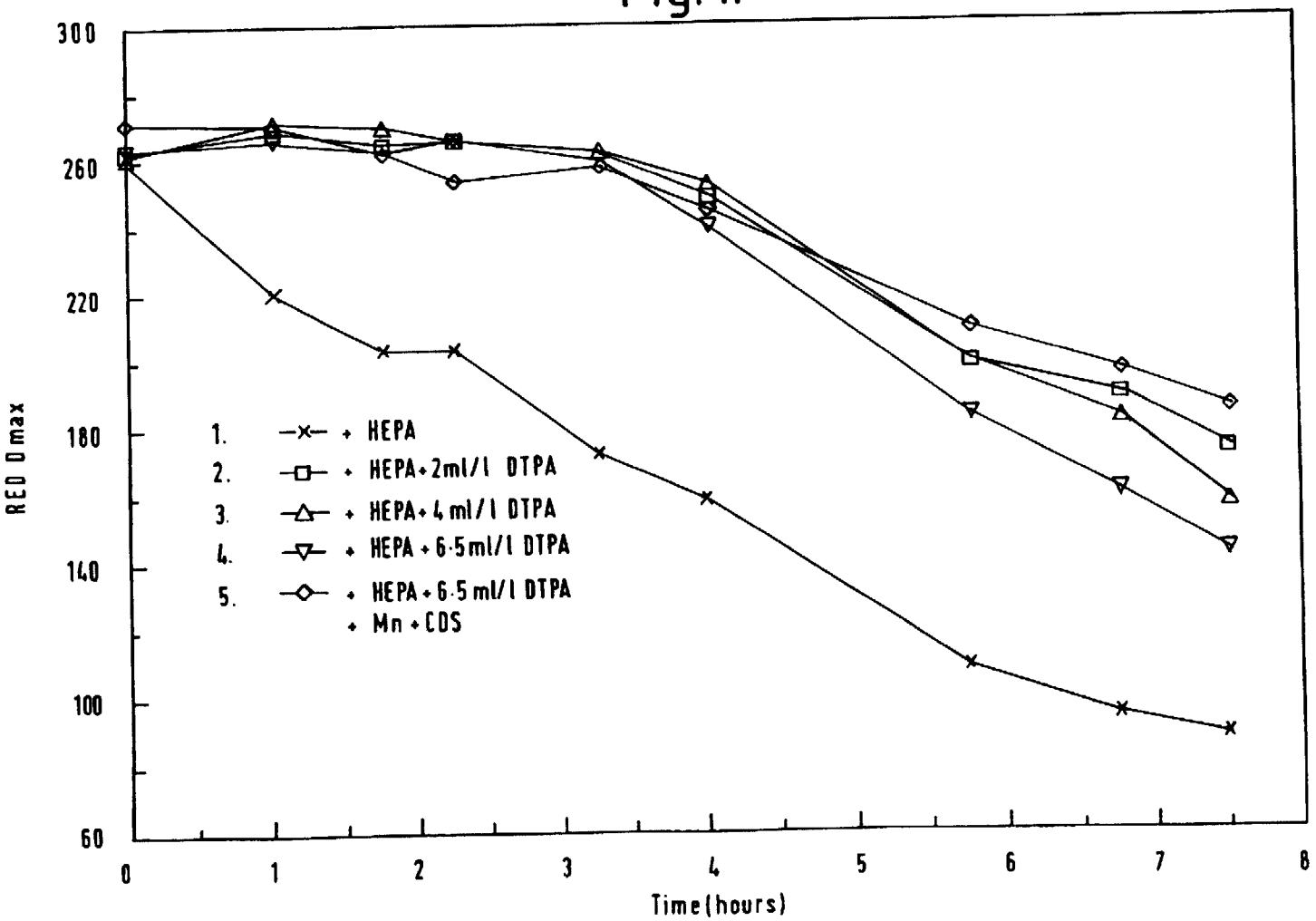

The results of the stability test in terms of red Dmax reflection density for a neutral exposure are shown graphically in FIG. 4.

The stability of solution 1, deteriorated steadily from the start, losing 20% Dmax in less than 2 hours, thence declining rapidly to 30% of the original after 7.5 hours.

There was only insignificant stability loss with solutions 2–5 until 4 hours had elapsed, whereupon each solution then declined to 65%, 62%, 55% and 69% respectively after 7.5 hours.

It will be noted that in this instance the most enhanced stability was found with the least amount of 'DTPA' showing the surprisingly small quantity of 'DTPA' required to provide a significant increase in stability, in the presence of 'HEPA'. As with Example 1 however, unexpectedly the addition of Mn/'CDS' provided an even better result despite the recognised disadvantageous catalysis normally associated with those impurities in the absence of 'DTPA', indicating the optimum result is obtainable with all three sequestering agents present.

Figure 5:
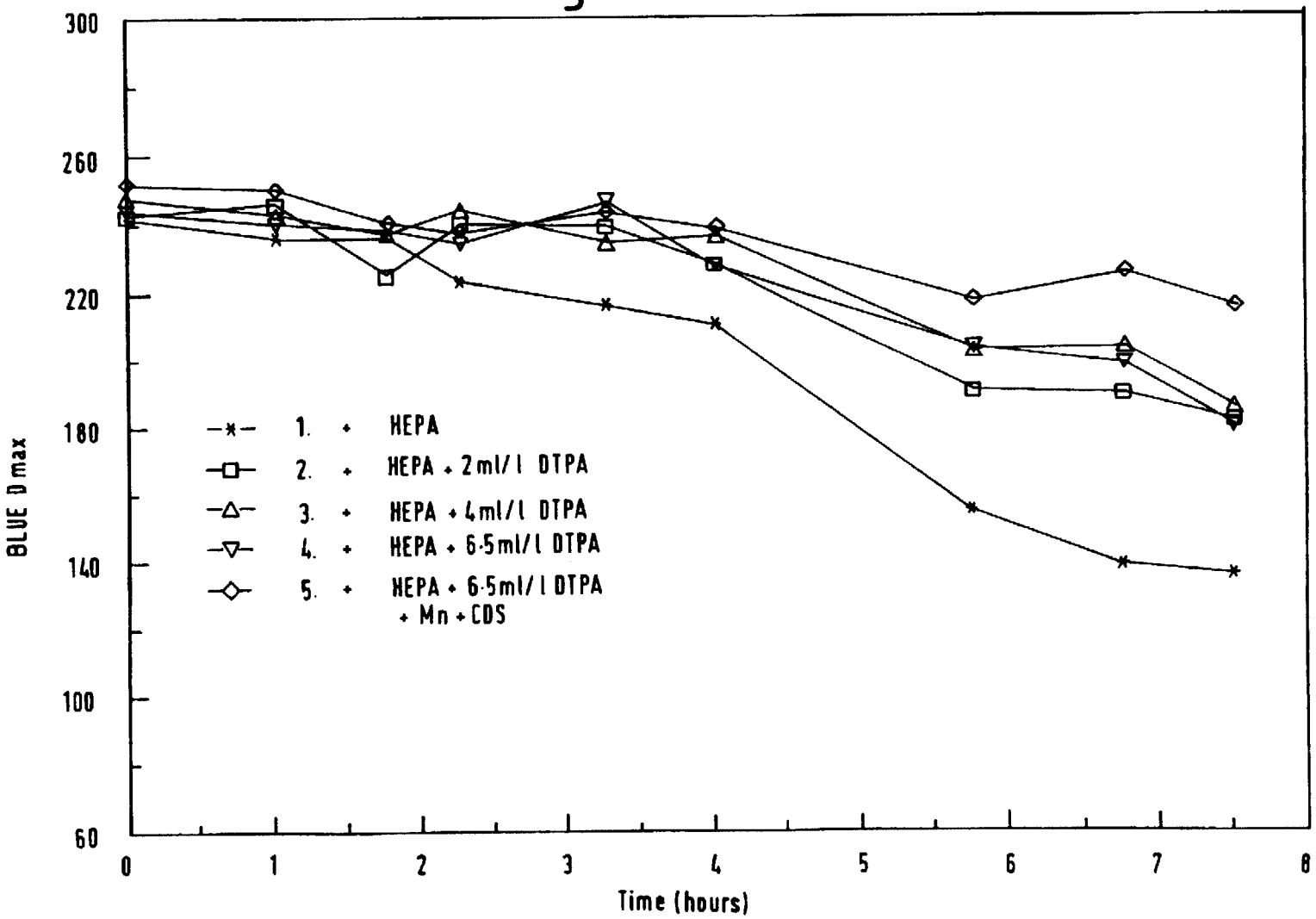

In a similar experiment for blue Dmax the results are depicted graphically in FIG. 5. Again solution 1 was the least stable falling to 54% after the end of the monitoring but in this instance no significant difference was observed between solutions 2, 3 and 4, all having declined to only about 75% at the end of the period. Once more solution 5 proved to have the greatest stability, falling only insignificantly to 88% even after 7.5 hours.

EXAMPLE 3

A similar experiment was set up to try and establish whether it was the Mn or 'CDS', in combination with the 'DTPA' and 'HEPA' that was primarily responsible for the unexpected enhancement in stability in comparing solutions 2 and 4 of FIG. 1. The solutions tested for stability in terms of red Dmax reflection were 1. The solution as in Example 1+0.6 g/l 60% solution in water of 'HEPA' (0.36 g/l, $1.7\times10^{-3}$ mole/l of 'HEPA')+2 m/l of a 40% solution of the penta-sodium salt of 'DTPA' (1.05 g/l, $2.1\times10^{-3}$ mole/l of 'DTPA')

Figure 6:
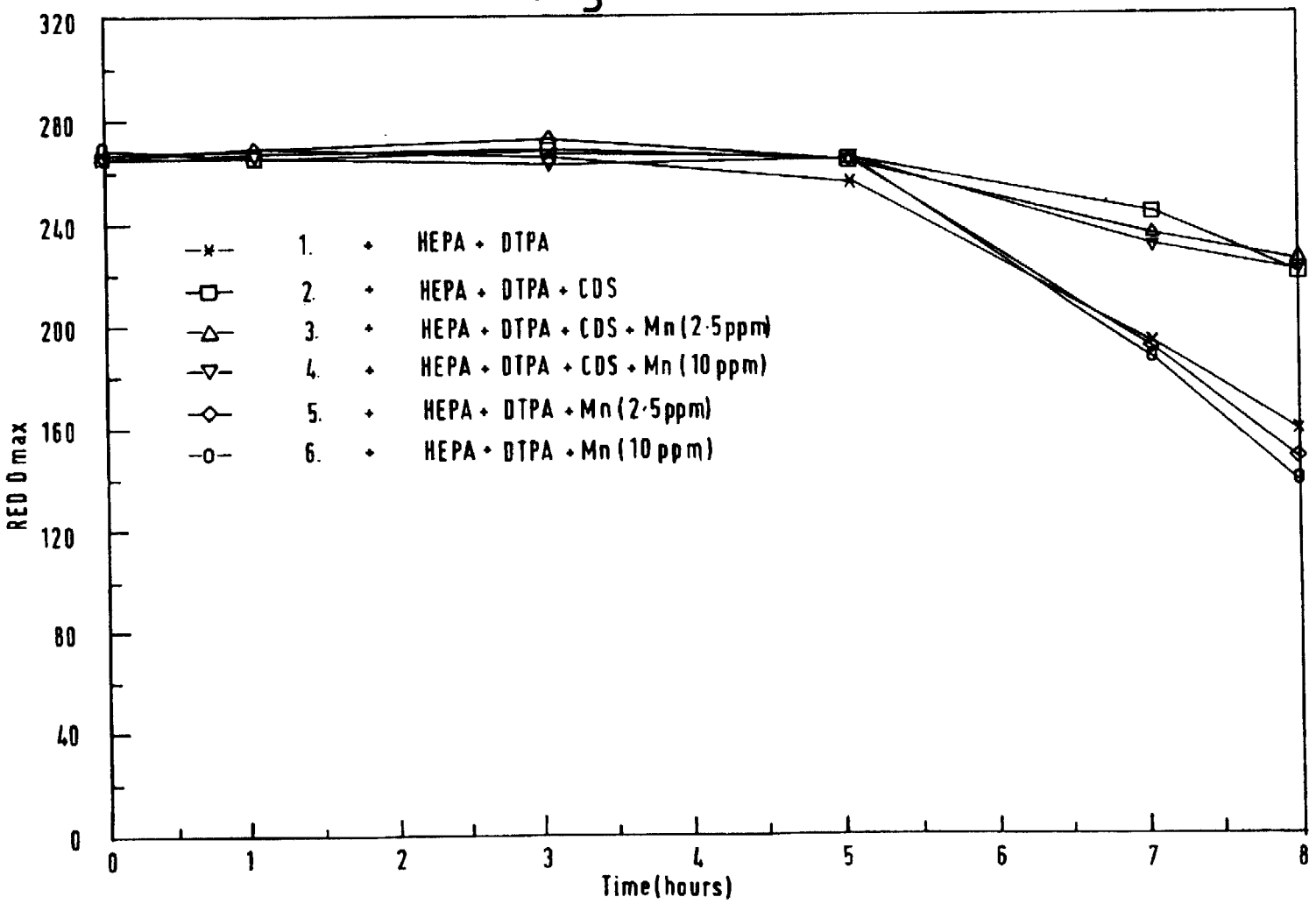

2. 1+'CDS' (0.6 g/l), $2.2\times10^{-3}$ mole/l 3. 1+'CDS' (0.6 g/l), $2.2\times10^{-3}$ mole/l+2.5 ppm Mn 4. 1+'CDS' (0.6 g/l), $2.2\times10^{-3}$ mole/l+10 ppm Mn 5. 1+2.5 ppm Mn 6. 1+10 ppm Mn The results, which are shown graphically in FIG. 6, show that there is no significant decline in stability for any of the solutions until after 5 hours have elapsed. Thereafter those solutions containing Mn but no 'CDS' mirrored closely solution 1 falling to just below 60% after 8 hours, whereas those to which 'CDS' but no Mn had been added retained 85% stability after this time.

These results show that it is the presence of the 'CDS' 'impurity', artificially added to the gelatin layer in the photographic material, together with the 'DTPA' and 'HEPA' that is apparently responsible, for the surprisingly high stability of solutions containing 'DTPA', 'HEPA' and 'CDS'/Mn.

I claim:

1. A redox-amplification solution comprising hydrogen peroxide or a substance capable of releasing hydrogen peroxide, a reducing agent, and in combination three or more sequestering agents, said sequestering agents being capable of complexing with transition metal ions emanating from an exposed silver halide photographic material, thereby inhibiting catalysis of the decomposition of the redox-amplification solution by said metal ions, wherein at least one sequestering agent is selected from the group consisting of polyalkylcarboxlic, polyalkylphosphonic or polyalkylsulphonic acid compounds of formula (I)

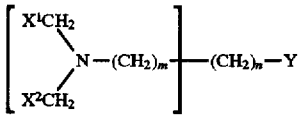

(I)

(A)

wherein $X^1$ and $X^2$ are the same or different and each is a hydrogen atom, a straight or branched chain alkyl group having 1 to 6 carbon atoms, a hydroxyl, carboxyl, sulphonyl or phosphonyl group, or a repeat unit of group A or group B, Y is a hydrogen atom, a straight or branched chain alkyl group having 1 to 6 carbon atoms, a hydroxyl, carboxyl, sulphonyl, or phosphonyl group, or the group B, wherein group B is

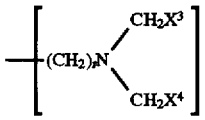

(B)

wherein $X^3$ and $X^4$ are the same or different and are as defined for $X^1$ and $X^2$, wherein the sum of m, n and r is an integer from 1 to 10, and wherein one or both of the hydrogen atoms in each of the $(CH_2)_m$, $(CH_2)_n$, or $(CH_2)_r$ groups may be replaced by a straight or branched chain alkyl group having 1 to 6 carbon atoms, with the proviso that at least one of $X^1$, $X^2$, $X^3$ and $X^4$ includes a carboxylic, sulphonic, or phosphoric acid group or a salt thereof, and at least one sequestering agent is selected from the group consisting of compounds of formula (II)

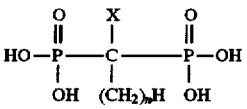

(II)

wherein X is a hydrogen atom, a halogen atom or a hydroxyl group and n is an integer from 0 to 12; and at least one sequestering agent is selected from the group consisting of polyhydroxyphenyl compounds of formula (III)

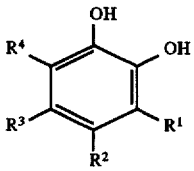

(III)

wherein $R^1$, $R^2$, $R^3$, and $R^4$ are the same or different and each is a hydrogen atom, a straight or branched chain alkyl group having 1 to 6 carbon atoms, a hydroxyl group, a sulphonyl group or a carboxyl group.

2. A redox-amplification solution as claimed in claim 1, wherein said compound of formula (I) is selected from the group consisting of ethylenediaminetetraacetic acid, propylenediaminetetraacetic acid, nitrilotriacetic acid, diethylenetriaminepentaacetic acid, and their corresponding sodium salts.

3. A redox-amplification solution as claimed in claim 2, wherein said compound of formula (I) is diethylenetriaminepentaacetic acid, said compound of formula (II) is 1-hydroxyethylidene-1,1-diphosphonic acid, and said compound of formula (III) is 4,5-dihydroxgbene-1,3-disulphonate.

4. A redox-amplification solution as claimed in claim 1, comprising a compound of formula (I,) wherein at least one of $X^1$, $X^2$, $X^3$ and $X^4$ is a carboxylic acid group.

5. A redox-amplification solution as claimed in claim 2, wherein the compound of formula (I) is diethylenetriaminepentaacetic acid, or salt thereof.

6. A redox-amplification solution as claimed in claim 2, wherein the compound of formula (I) is ethylenediaminetetraacetic acid, or a salt thereof.

7. A redox-amplification solution as claimed claim 2, wherein the compound of formula (I) is propylenediaminetetraacetic acid, or a salt thereof.

8. A redox-amplification solution as claimed in claim 2, wherein the compound of formula (I) is nitrilotriacetic acid, or a salt thereof.

9. A redox-amplification solution as claimed claim 1, wherein the compound of formula (II) is 1-hydroxyethylidene-1,1-diphosphonic acid.

10. A redox-amplification solution as claimed in claim 1, wherein the compound of formula (III) is 3,4-dihydroxyphenyl-1-sulphonate.

11. A redox-amplification solution as claimed in claim 1, comprising in combination, diethylenetriaminepentaacetic acid or a salt thereof, 1-hydroxy-ethylidene-1,1-diphosphonic acid and catechol 1-sulphonate.

12. A redox-amplification solution as claimed in claim 1, wherein the amount of polyhydroxy compound of formula (III) is present in an amount of about $10^{-3}$ mole/l.

13. A redox-amplification solution as claimed in claim 1, wherein the sequestering agent of formula (II) is present in an amount of about $10^{-3}$ mole/l.

14. A redox-amplification solution as claimed in claim 1, wherein the amount of the sequestering agent of formula (I) is present in an amount of about $10^{-3}$ mole/l.

15. A redox-amplification solution as claimed in claim 1, wherein 30% hydrogen peroxide is used in an amount of from 0.5 to 100 ml/liter, of redox-amplification solution.

16. A redox-amplification solution as claimed in claim 1, wherein the reducing agent is N-ethyl-N-β-methanesulphonamidoethyl-3-methyl-4-aminoaniline.

17. A redox-amplification solution as claimed in claim 1, wherein the reducing agent is present in an amount of from about 1 to 20 g/liter.

18. A method of processing an exposed silver halide color photographic material including a radox-amplification step, said method comprising:

processing said exposed photographic material in a radox-amplification solution containing hydrogen peroxide, or a compound capable of releasing hydrogen peroxide, a reducing agent, and in combination three or more sequestering agents, said sequestering agents being capable of complexing with transition metal ions emanating from an exposed silver halide photographic material, thereby inhibiting catalysis of the decomposition of the radox-amplification solution by said metal ions, wherein at least one sequestering agent is selected from the group consisting of polyalkylcarboxylic, polyalkylphosphonic or polyalkylsulphonic acid compounds of formula

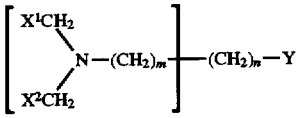

(I)

(A)

wherein $X^1$ and $X^2$ are the same or different and each is a hydrogen atom, a straight or branched chain alkyl group having 1 to 6 carbon atoms, a hydroxyl, carboxyl, sulphonyl or phosphonyl group, or a repeat unit of group A or group B, Y is a hydrogen atom, a straight or branched chain alkyl group having 1 to 6 carbon atoms, a hydroxyl, carboxyl, sulphonyl, or phosphonyl group, or the group B, wherein group B is

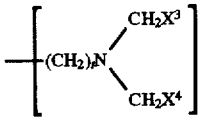

(B)

wherein $X^3$ and $X^4$ are the same or different and are as defined for $X^1$ and $X^2$, wherein the sum of m, n and r is an integer from 1 to 10, and wherein one or both of the hydrogen atoms in each of the $(CH_2)_m$, $(CH_2)_n$ or $(CH_2)_r$ groups may be replaced by a straight or branched chain alkyl group having 1 to 6 carbon atoms, with the proviso that at least one of $X^1$, $X^2$, $X^3$ and $X^4$ includes a carboxylic, sulphonic, or phosphoric acid group or a salt thereof, and at least one sequestering agent is selected from at least one of the group consisting of compounds of formula (II)

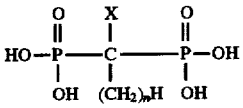

(II)

wherein X is a hydrogen atom, a halogen atom or a hydroxyl group and n is an integer from 0 to 12; and at least one sequestering agent is selected from the group consisting of polyhydroxyphenyl compounds of formula (III)

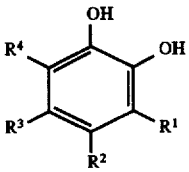

(III)

wherein $R^1$, $R^2$, $R^3$, and $R^4$ are the same or different and each is a hydrogen atom, a straight or branched chain alkyl group having 1 to 6 carbon atoms, a hydroxyl group, a sulphonyl group or a carboxyl group.

19. The method of claim 18 wherein the redox-amplification solution comprises hydrogen peroxide or a compound capable of producing hydrogen peroxide, N-ethyl-N-β-methanesulfonamidoethyl-3-methyl-4-aminoaniline as the reducing agent, and a sequestering agent selected from the group consisting of ethylenediaminetetraacetic acid, propylenediaminetetraacetic acid, nitrilotriacetic acid, diethylenetriaminepentaacetic acid, and salts thereof.

20. A method as claimed in claim 18, wherein said compound of formula (I) is diethylenetriaminepentaacetic acid, said compound of formula (II) is 1-hydroxyethylidene-1,1-diphosphonic acid, and said compound of formula (III) is 4,5-dihydroxybenzene-1,3-disulphonate.

* * * * *